United States Patent [19]

Fehrer

[11] 4,249,368

[45] Feb. 10, 1981

[54] APPARATUS FOR MANUFACTURING A YARN

[76] Inventor: Ernst Fehrer, Auf der Gugl 28, A-4020 Linz, Austria

[21] Appl. No.: 25,369

[22] Filed: Mar. 30, 1979

[30] Foreign Application Priority Data

May 26, 1978 [AT] Austria ..... 3813/78
Aug. 28, 1978 [AT] Austria ..... 6228/78
Sep. 8, 1978 [AT] Austria ..... 6490/78

[51] Int. Cl.[3] ..... D01H 1/12; D02G 3/36

[52] U.S. Cl. ..... 57/5; 57/6; 57/58.95

[58] Field of Search ..... 57/5, 6, 58.89–58.95

[56] References Cited

U.S. PATENT DOCUMENTS 3,981,137 9/1976 Fehrer ..... 57/58.95 X
4,056,924 11/1977 Umiastowski ..... 57/5
4,067,181 1/1978 Fehrer ..... 57/58.95 X
4,070,811 1/1978 Fehrer ..... 57/58.95 X
4,107,909 8/1978 Fehrer et al. ..... 57/5
4,130,983 12/1978 Dammann et al. ..... 57/58.95 X

*Primary Examiner*—John Petrakes
*Attorney, Agent, or Firm*—Kurt Kelman

[57] ABSTRACT

Apparatus for manufacturing a yarn comprises two juxtaposed, closely spaced apart vacuum drums, which rotate in the same sense and have vacuum zones that adjoin the triangular space between the drum. A drawing frame delivers a drawn sliver at one end of said drums to said triangular space, in which the sliver is twisted to form a yarn, which is then withdrawn by means provided at the opposite end of the drums. To ensure a uniform quality of the yarn and to enable the yarn to be withdrawn at high speed, at least one additional roller drawing frame is provided, which has a delivery end disposed over the triangular space and can be operated to deliver wrapping fibers in the form of at least one stream of drawn fibers moving transversely to the longitudinal direction of the drums to the sliver, which extends in the longitudinal direction of the drums.

10 Claims, 2 Drawing Figures

APPARATUS FOR MANUFACTURING A YARN

Figure 1:
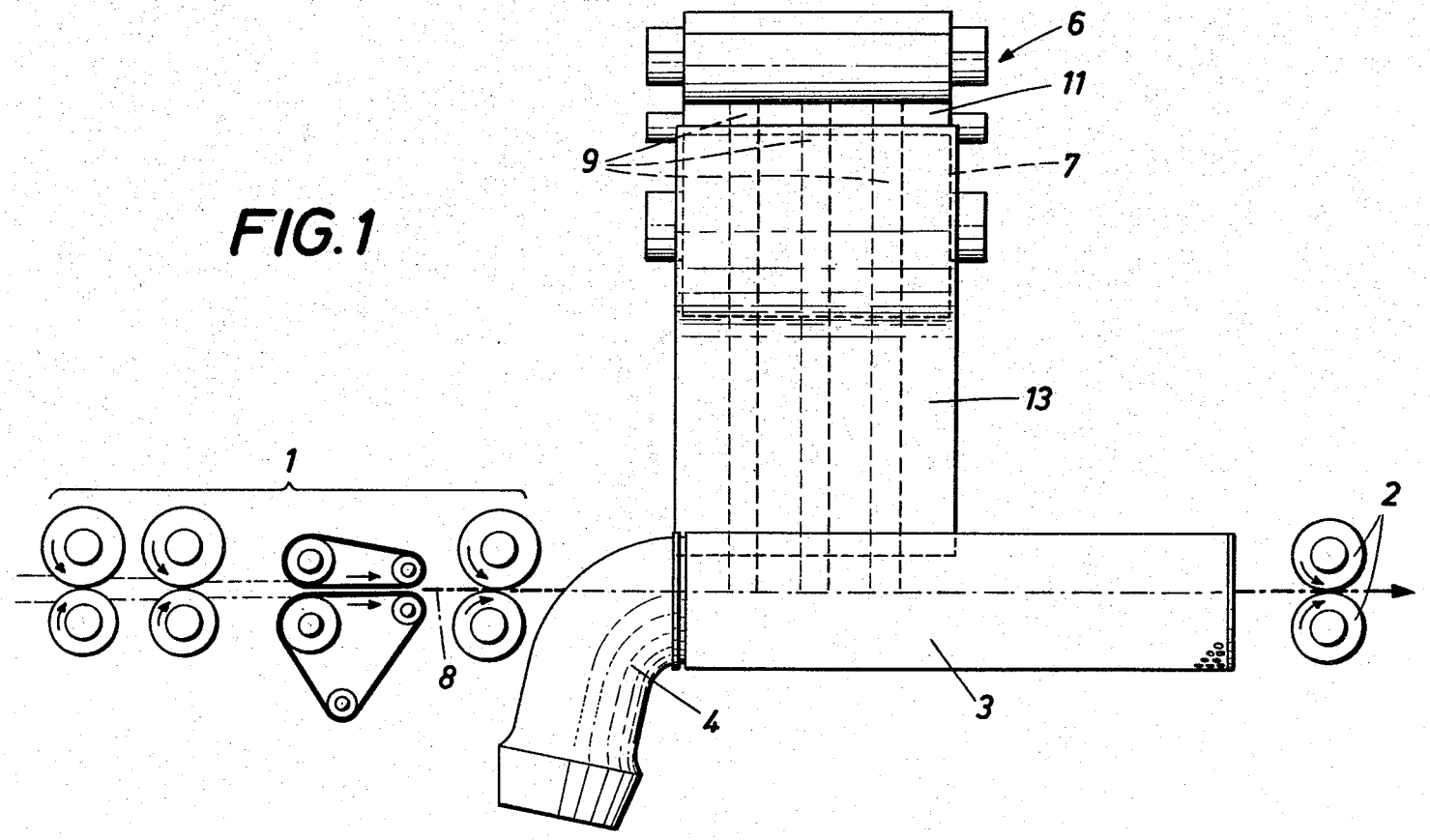

This invention relates to apparatus for manufacturing a yarn, comprising two juxtaposed, closely spaced vacuum drums, which rotate in the same sense and define a triangular space between them and adjacent to said space have suction zones, a drawing frame disposed at one end of the drums and supplying a drawn sliver to said triangular space, and withdrawing means disposed at the other end of said drums and serving to withdraw a yarn which has been formed in said triangular space from said sliver.

Because slivers can be highly drawn but cannot be transported alone, they must be spun immediately after having been drawn. The yarn which has been formed directly from the sliver is withdrawn at a speed of about 50 meters per minute. That low speed of withdrawal involves an entirely unsatisfactory production rate.

In an effort to provide decisive improvements in this respect, a spinning apparatus disclosed in Austrian Pat. Specification No. 345,701 has been provided in which wrapping fibers flying from a disintegrator are supplied to the sliver, which is moved in the triangular space between two juxtaposed, closely spaced vacuum drums, which rotate in the same sense. Because the drawn sliver is held against rotation by the drawing frame which precedes the vacuum drums and by the pair of withdrawing rollers which succeed the drums, the sliver between the two vacuum drums will be subjected only to false twisting unless the twist imparted to the sliver fibers by the vacuum drums is fixed or stabilized by the individual fibers which fly into the triangular space and in said space wrap around the sliver fibers. Because the sliver fibers are wrapped by the inflying fibers in the triangular space between the two vacuum drums, the yarn can be withdrawn at high speed and the sliver can be highly drawn without endangering its coherence.

The force which opposes the untwisting in the false-twisting sense of the fibers of the drawn sliver between the twisting point, disposed adjacent to the end of the vacuum drums near the drawing frame, and the pair of withdrawing rollers, will be the stronger the smaller is the helix angle of the individual fibers which are helically wrapped around the sliver fibers. On the other hand, the individual fibers flying from the disintegrator into the triangular space have no defined orientation so that at least part of said fibers are parallel to the fibers of the sliver as they impinge thereon and when twisted assume approximately the same helix angle as the sliver fibers. Such individual fibers can no longer prevent an untwisting of the sliver fibers. As a result, a constant quality of the resulting yarn cannot be ensured.

It is an object of the invention so to improve an apparatus of the kind described first hereinbefore that the yarn can be withdrawn at a higher speed and a uniform quality of the yarn is ensured.

This object is accomplished according to the invention in that at least one additional roller drawing frame is provided, which has a delivery end disposed over the triangular space and is operable to deliver in the form at least one stream of drawn wrapping fibers in a direction which is transverse to the longitudinal direction of the drums to the sliver which extends in the longitudinal direction of the drums.

In this apparatus the wrapping fibers which serve to fix the twist of the sliver fibers extending generally in the longitudinal direction of the drums no longer fly as randomly oriented fibers into the triangular space between the vacuum drums but are delivered in the form of a stream of drawn fibers in a predetermined orientation to the sliver fibers which are to be wrapped. The wrapping fibers have been parallelized by drawing and extend transversely to the fibers to be wrapped, as is desired. As a result, the helix angle of the wrapping fibers is as small as possible so that the twist of the sliver fibers can be fixed by a minimum amount of wrapping fibers. As the delivery end of the roller drawing frame for delivering the wrapping fibers is disposed over the triangular space, the wrapping fibers can be substantially freely delivered from the pair of delivery rollers of the roller drawing frame to the sliver extending in the longitudinal direction of the drums and such delivery will not be hindered by the rotating vacuum drums. This ensures also that the wrapping of the sliver fibers forming the core of the yarn will not be disturbed by turbulence and the resulting yarn can be withdrawn at very high speed. It is also possible to make very fine yarns, i.e., yarns having high counts, because the stream of fibers which are fed to the yarn core consists of parallelized fibers. In this connection it is not significant whether the wrapping fibers are supplied to the roller drawing frame in the form of one or more slivers or of a non-woven web.

To provide the best conditions for the manufacture of uniform, thin yarns, the contact between the individual wrapping fibers in the stream of fibers should be eliminated as far as possible before the fibers reach the yarn core so that virtually individualized, parallel fibers are obtained as far as possible. Such individual fibers ensure a particularly uniform fixation of the twist of the sliver fibers. In order to accomplish this object, the pair of delivery rollers of the roller drawing frame may define a nip which permits of a slip between the delivery rollers and the wrapping fibers. Because a slip is enabled between the delivery rollers and the wrapping fibers, each wrapping fiber will not be forwarded by the pair of delivery rollers until the next preceding pair of rollers have released the fiber. The fibers being forwarded are then virtually pulled out of the strip formed by the remaining fibers because these are still gripped by the preceding pair of rollers. To ensure that the fibers will be reliably entrained, on the one hand, and that the required slip is enabled, on the other hand, when the fibers are still gripped by the next preceding pair of rollers, the width of the nip defined by the delivery rollers must be selected in dependence on the diameter of the wrapping fibers. The width of the nip should be at least 1.5 times the diameter of the wrapping fibers. It is believed that a nip having a width of an order of 0.1 to 0.2 mm will be suitable in practice.

The disintegration of the strip of fibers obviously depends also on the distance from the pair of delivery rollers of the roller drawing frame to the next preceding pair of rollers because the latter must restrain those fibers which have not yet been engaged by the delivery rollers. This requirement will be reliably met if the distance from the pair of delivery rollers to the next preceding pair of rollers is smaller than the length of the wrapping fibers, although the fibers will also be restrained if said distance slightly exceeds the length of the wrapping fibers. Optimum results will be obtained if the distance from the pair of delivery rollers of the roller drawing frame to the nip of the next preceding pair of rollers is approximately as large as the length of the wrapping fibers. In that case the slippage and the stressing of the fibers can be small whereas the restraining action of the next preceding pair of rollers is not adversely affected. When the fibers released by the next preceding pair of rollers are pulled out of the strip of fibers, this pulling results not only in a disintegration of the strip of fibers but ensures also a higher degree of parallelism of the fibers.

To enable a substantial distintegration of the strip of fibers by means of the delivery rollers, the peripheral velocity of the pair of delivery rollers must be higher than the peripheral velocity of the next preceding pair of rollers, as is always the case in drawing frames, in which the peripheral velocity of the pair of delivery rollers is usually 10 to 30 times the peripheral velocity of the next preceding pair of rollers. This velocity ratio is not sufficient for a substantial disintegration of the strip of fibers into parallelized individual fibers. For this purpose the peripheral velocity of the pair of delivery rollers should be at least 100 times and preferably 400 to 600 times higher than the peripheral velocity of the next preceding pair of rollers.

When the delivery rollers have engaged the wrapping fibers the latter are advanced as substantially parallelized individual fibers toward the triangular space between the vacuum drums. This advance of the wrapping fibers as well as the air which surrounds and is entrained by the wrapping fibers have an adverse effect on the perfect straightening of the wrapping fibers. This adverse effect can be avoided by the provision of two guide walls, which are disposed between the pair of delivery rollers of the roller drawing frame and the vacuum drums and protrude into the triangular space between the vacuum drums and define for the wrapping fibers a guide passage which tapers from the pair of delivery rollers toward the vacuum drums. Because the guide walls protrude into the triangular space between the vacuum drums, the guide passage defined by the guide walls virtually adjoins the suction zones so that an air flow will be created in the tapering guide passage at a velocity which increases toward the triangular space. This air flow between the guide wall accelerates the fibers which are ejected between the delivery rollers of the roller drawing frame so that the leading end of each wrapping fiber will be subjected to a tensile force which tends to straighten the fiber. As a result, the desired high degree of parallelism is actually achieved.

The guide passage defined by the guide walls has also a favorable effect on the air flow conditions adjacent to the pair of delivery rollers because any air cushions and vortices of air will be sucked off so that the controlled movement of the fibers will be promoted.

If at least one roller of the pair of delivery rollers has elevations, such as teeth, which are spaced apart along and around the roller, this will promote the pulling of the fibers from the strip of fibers and will permit to some extent of a flow of air through the nip between the delivery rollers so that vortices of air on the entrance side of the pair of delivery rollers will be sucked off.

To ensure that the wrapping fibers entering the triangular space between the vacuum drums cannot hinder the twisting of the fibers of the yarn core in said triangular space, the twisting of the fibers of the yarn core must not depend on the exit velocity of the wrapping fibers leaving the pair of delivery rollers, as would be the case if the distance from the pair of delivery rollers to the sliver, which extends in the longitudinal direction of the drums, was smaller than the length of the wrapping fibers. For this reason said distance must exceed the length of the wrapping fibers.

Figure 2:
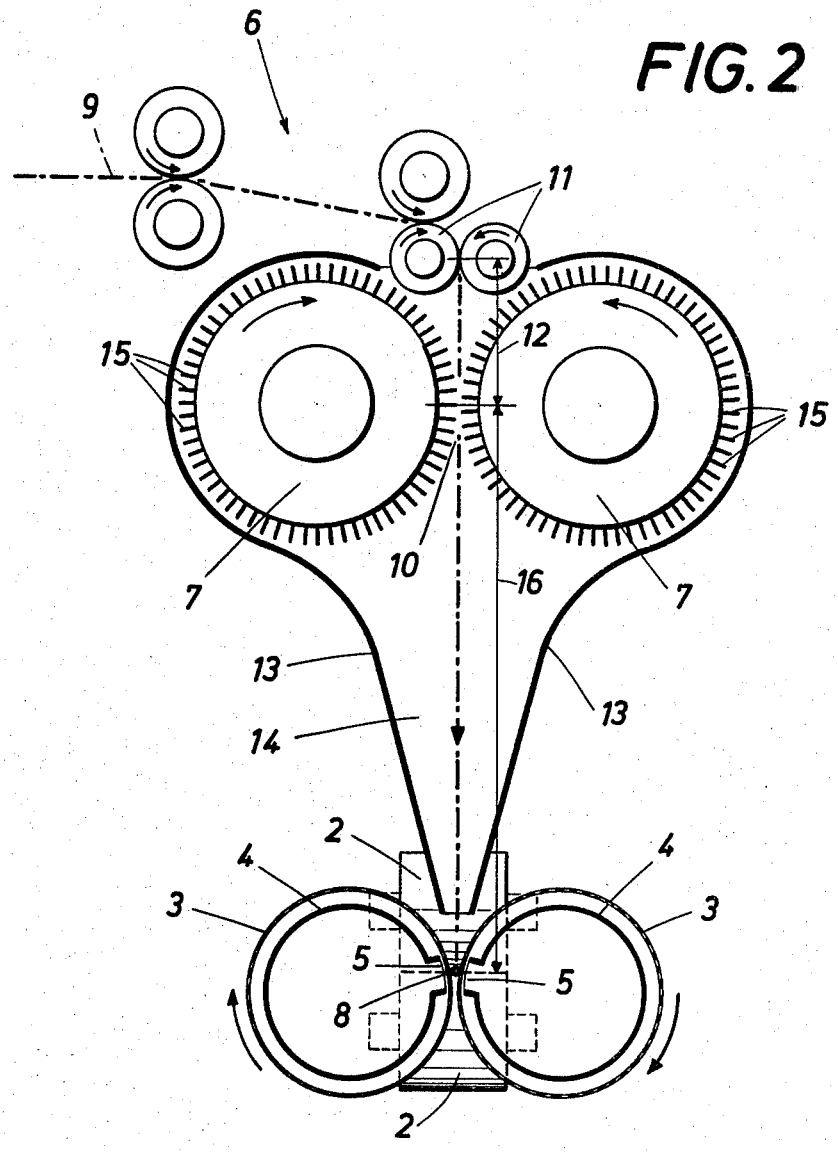

An embodiment of the invention is shown by way of example on the accompanying drawings, in which FIG. 1 is a side elevation showing apparatus according to the invention for manufacturing yarn and FIG. 2 is an enlarged vertical sectional view showing that apparatus.

Two juxtaposed, parallel vacuum drums 3, which are closely spaced apart and rotate in the same sense, are disposed between a drawing frame 1 and withdrawing rollers 2. The drawing frame 1 consists of a plurality of pairs of rollers, the peripheral velocities of which greatly increase from the receiving end to the delivery end of the drawing frame. Each vacuum drum 3 has a vacuum insert 4. These vacuum inserts 4 define suction zones 5, which face each other and adjoin the triangular space between the vacuum drums.

A roller drawing frame 6 is disposed over the vacuum drums 3 and at its delivery end, disposed over the triangular space between the two vacuum drums, comprises a pair of delivery rollers 7. A sliver 8 which has been drawn in the drawing frame 1 is twisted between the vacuum drums 6. The sliver 8 can be supplied by the roller drawing frame 6 with wrapping fibers consisting of drawn slivers 9. These wrapping fibers are wrapped around the sliver 8 in order to fix the twist thereof. The slivers 9 could be replaced by streams of fibers in a different form, e.g., by a non-woven web. It will be possible that a yarn can also be made if only a single sliver 9 is supplied.

The roller drawing frame 6 distinguishes from conventional drawing frames by features which are intended to ensure a high degree of parallelism of the individual fibers and a substantial disintegration of the fibers of the stream. For this purpose, the pair of delivery rollers 7 define a nip 10 which permits of a slip between the rollers and the wrapping fibers. Besides, the peripheral velocity of the pair of delivery rollers 7 is preferably 400 to 600 times the peripheral velocity of the next preceding pair of rollers 11 so that those fibers of the slivers 9 which have been released by the rollers 11 are pulled by the delivery rollers 7 out of the strip formed by the remaining fibers so that said strip is disintegrated and the fibers are parallelized to a high degree. It is essential in this connection that only those fibers which have been engaged by the delivery rollers 7 are pulled out of the strip of fibers and that the remaining fibers are still gripped by the next preceding pair of rollers 11. This requires that there is a very large difference between the peripheral velocities of the rollers 7 and 11 and that the distance between these two pairs of rollers does not exceed a certain upper limit. If the distance 12 between the pair of delivery rollers 7 and the nip of the next preceding pair of rollers 11 exceeds about 1.5 times the length of a wrapping fiber, those fibers which have already been engaged by the delivery rollers 7 will entrain a substantial part of the fibers which have not yet been engaged by the delivery rollers and are no longer restrained by the rollers 11. If the distance 12 is smaller than the length of the wrapping fibers, it will be ensured that the rollers 11 restrain all fibers which have not yet been engaged by the delivery rollers 7 but in that case the high friction will result in a comparatively high stress on the fibers. A gentle handling of the fibers will be ensured if the distance 12 is approximately as large as the length of the wrapping fibers. This distance will also ensure a favorable restraining action of the preceding pair of rollers 11.

To enable a straightening tensile force to be exerted on the wrapping fibers as they emerge from the delivery rollers 7, two guide walls 13 are provided, which are disposed between the delivery rollers 7 and the vacuum drums 3 and protrude into the triangular space between the vacuum drums 3 and define for the wrapping fibers a guide passage 14, which tapers from the delivery rollers 7 toward the vacuum drums. The vacuum produced in the triangular space by the vacuum zones 5 results in the guide passage 14 in an air flow at a velocity which steadily increases toward the vacuum drums as a result of the taper of the guide passage. As a result of this air flow, the fibers emerging between the rollers are subjected to a tensile force which tends to straighten the fibers and preserves the desired parallelism of the individual fibers until they are tied into the yarn.

The air flow produced in the guide passage 14 acts through the nip 10 also on the receiving side of the rollers 7 so that vortices of air which otherwise occur in that region and would disturb the controlled movement of the fibers will be sucked off. This flow of air between the rollers 7 is promoted by teeth 15, which are provided on the rollers 7 and obviously promote also the separation of the individual fibers from the strip of the remaining fibers.

To ensure that the parallelized wrapping fibers can be wrapped around the sliver 8 without hindering the twisting thereof, the distance 16 from the pair of delivery rollers 7 to the sliver 8 should exceed the length of the wrapping fibers so that the delivery rollers 7 cannot restrain the wrapping fibers.

What is claimed is:

1. Apparatus for manufacturing yarn, comprising two juxtaposed, closely spaced vacuum drums which define an open-topped triangular space between them and have suction zones adjoining said triangular space and facing each other, a drawing frame for delivering a drawn sliver to said triangular space at one end thereof, said drums being rotatable in the same sense to twist said sliver so as to form a yarn, means for withdrawing said yarn from said triangular space at the opposite end thereof, whereby said sliver is caused to extend in said triangular space in the longitudinal direction of said drums, and at least one roller drawing frame having a delivery end disposed over said triangular space and operable to deliver at least one stream of drawn wrapping fibers oriented substantially parallel to each other and transversely to the longitudinal direction of said drums to said sliver in said triangular space.

2. Apparatus as set forth in claim 1, in which said roller drawing frame comprises a pair of delivery rollers which define a nip that permits of a slip between the delivery rollers and the wrapping fibers.

3. Apparatus as set forth in claim 2, for use with wrapping fibers having a predetermined diameter, in which said nip has a width in excess of 1.5 times said diameter.

4. Apparatus as set forth in claim 2, for use with wrapping fibers having approximately a predetermined length, in which said roller drawing frame comprises a second pair of rollers, which serve to handle said wrapping fibers and precede said pair of delivery rollers and define a nip, which is spaced from said pair of delivery rollers by a distance which is approximately as large as said predetermined length.

5. Apparatus as set forth in claim 2, in which said roller drawing frame comprises a second pair of rollers, which serve to handle said wrapping fibers and precede said pair of delivery rollers and in which said delivery rollers are operable at a peripheral velocity which is at least 100 times the peripheral velocity of said second pair of rollers.

6. Apparatus as set forth in claim 5, in which said delivery rollers are operable at a peripheral velocity which is 400 to 600 times the peripheral velocity of said second pair of rollers.

7. Apparatus as set forth in claim 1, in which said roller drawing frame comprises at said delivery end a pair of delivery rollers for handling said wrapping fibers, and two guide walls extend from adjacent to said delivery rollers into said triangular space and define a guide passage which tapers toward said triangular space.

8. Apparatus as set forth in claim 1, in which said roller drawing frame comprises at said delivery end a pair of delivery rollers for handling said wrapping fibers and at least one of said delivery rollers is provided on its peripheral surface with elevations spaced apart along and around said roller.

9. Apparatus as set forth in claim 8, in which said elevations consist of teeth.

10. Apparatus as set forth in claim 1, for use with wrapping fibers having approximately a predetermined length, in which said roller drawing frame comprises at said delivery end a pair of delivery rollers for handling said wrapping fibers and said delivery rollers are spaced by a distance in excess of said predetermined length from said sliver extending in said triangular space in the longitudinal direction of said drums.

* * * * *